United States Patent [19]

Taki

[11] Patent Number: 4,909,675

[45] Date of Patent: Mar. 20, 1990

[54] IN SITU REINFORCED STRUCTURAL DIAPHRAGM WALLS AND METHODS OF MANUFACTURING

[76] Inventor: Osamu Taki, 2558 Somerset Dr., Belmont, Calif. 94002

[21] Appl. No.: 236,635

[22] Filed: Aug. 24, 1988

[51] Int. Cl.[4] ..... E02D 5/18

[52] U.S. Cl. ..... 405/267; 405/269; 405/241

[58] Field of Search ..... 405/267, 266, 258, 263, 405/269, 232, 240, 241

[56] References Cited

U.S. PATENT DOCUMENTS

| | | | |
|---|---|---|---|
| 3,823,562 | 7/1974 | Bacmanak | 405/267 |
| 3,969,902 | 7/1976 | Ichise et al. | 405/266 X |
| 4,043,909 | 8/1977 | Endo et al. | 210/49 |
| 4,063,424 | 12/1977 | Takagi et al. | 61/63 |
| 4,065,928 | 1/1978 | Takagi et al. | 61/36 |
| 4,065,933 | 1/1978 | Katayama | 61/50 |
| 4,069,678 | 1/1978 | Miura et al. | 61/63 |
| 4,084,383 | 4/1978 | Kukino et al. | 61/36 |
| 4,089,183 | 5/1978 | Endo et al. | 61/50 |
| 4,189,239 | 2/1980 | Miyaguchi et al. | 366/169 |
| 4,268,192 | 5/1981 | Colle | 405/267 X |
| 4,402,630 | 9/1983 | Miura et al. | 405/266 |
| 4,412,548 | 7/1980 | Miyaguchi et al. | 366/348 |
| 4,436,453 | 3/1984 | Miura et al. | 405/263 |
| 4,449,856 | 5/1984 | Tokoro et al. | 405/269 |
| 4,475,847 | 10/1984 | Cornely et al. | 405/264 |
| 4,537,536 | 8/1985 | Tsubonuma et al. | 405/267 |

FOREIGN PATENT DOCUMENTS

| | | | |
|---|---|---|---|
| 1072071 | 9/1954 | France | 405/267 |
| 51-71605 | 6/1976 | Japan . | |
| 52-78302 | 6/1977 | Japan . | |
| 52-152608 | 12/1977 | Japan . | |
| 55-44812 | 11/1980 | Japan . | |
| 0156317 | 12/1981 | Japan | 405/267 |
| 58-29374 | 6/1983 | Japan . | |
| 58-29375 | 6/1983 | Japan . | |
| 0189414 | 11/1983 | Japan | 405/267 |
| 0270414 | 11/1986 | Japan | 405/267 |

OTHER PUBLICATIONS

"S.M.W. Machine", Product Brochure of S.M.W. Seiko, Inc., San Francisco, Calif.

"Teno Column Method", Product Brochure of the Tenox Corporation, Toyko, Japan.

"Just One of Our Fleet", Product Advertisement, Casagrande S.p.A., Italy.

"The Soil Mixing Wall (SMW Technique)–Guidelines for Its Design and Implementation," Japanese Materials Institute.

"In Situ Soil Improvement Techniques, Lime Columns," Clough, Harbour & Assoc., New York.

Jasperse and Ryan, "Geotech Import: Deep Soil Mixing", Civil Engineering, pp. 66–68 (Dec. 1987).

*Primary Examiner*—Dennis L. Taylor

*Attorney, Agent, or Firm*—Workman, Nydegger & Jensen

[57] ABSTRACT

The present invention is directed to in situ structural diaphragm walls and methods for constructing such walls. The structural diaphragm walls of the present invention are comprised of a series of small and large-diameter soilcrete columns configured such that the small-diameter columns alternate with the large-diameter columns. A structural member, such as a steel I-beam, is placed within each of the small-diameter columns or within each of the large diameter columns, depending on the structural requirements of the resulting diaphragm wall.

The structural diaphragm wall is capable of withstanding the lateral forces which may be imposed by soil or water. Thus, the wall is ideally suited for construction applications when ground water must be restrained or when soil adjacent an excavation site is in danger of crumbling because of the loss of the lateral support which existed prior to excavation.

The method of constructing the structural diaphragm wall involves employing a three-shaft auger machine to construct a series of soilcrete columns. Before the soilcrete mixture cures, the structural diaphragm wall may be aligned with the column and directed into the column, usually under its own weight. The soilcrete mixture is then allowed to cure, resulting in the reinforced structural diaphragm wall of the present invention.

37 Claims, 5 Drawing Sheets

IN SITU REINFORCED STRUCTURAL DIAPHRAGM WALLS AND METHODS OF MANUFACTURING

BACKGROUND

1. The Field of the Invention

The present invention relates to structural diaphragm walls constructed by reinforced soilcrete columns and processes for constructing such walls. More particularly, the present invention utilizes load bearing members, such as a steel I-beam, in combination with soilcrete columns of various diameters to produce a structural diaphragm wall more efficiently and stronger than the currently used techniques in the art.

2. Related Application

This patent application is a continuation-in-part of copending U.S. patent application Ser. No. 07/172,286, filed Mar. 23, 1988, in the name of Osamu Taki, and entitled "MULTI-SHAFT AUGER APPARATUS AND PROCESS FOR FIXATION OF SOILS CONTAINING TOXIC WATERS," which patent application is incorporated herein by specific reference.

3. The Prior Art

For a number of years, auger machines have been used in Japan to construct concrete-like columns in the ground without having to excavate the soil. These columns are sometimes referred to as "soilcrete" columns, because the soil is mixed with a cement hardener in situ. Upon hardening, the soilcrete columns possess characteristics of concrete columns, but they are constructed without the expense and time consuming processes of removing and replacing the soil with concrete.

To produce soilcrete columns, a multi-shaft auger machine bores holes in the ground and simultaneously mixes the soil with a chemical hardening material pumped from the surface through the auger shaft to the end of the auger. Multiple columns are prepared while the soil-cement mixture is still soft in order to form continuous walls or geometric patterns within the soil, the particular shape or pattern depending on the purpose of the soilcrete columns.

Because the soil is mixed in situ and because the soilcrete wall is formed in a single process step, the construction period is shorter than for other construction methods. Obviously, the costs of forming soilcrete columns are less than traditional methods requiring excavation of the soil in order to form concrete pillars or walls. In addition, because the soil is not removed from the ground, there is comparatively little material (produced by such in situ processes) that must be disposed of during the course of construction.

The soilcrete columns have been arranged in a variety of patterns depending on the desired application. Soilcrete columns are used to improve the load bearing capacity of soft soils, such as sandy or soft clay soils. The columns are formed deep in the ground and form a solid base or "foundation" for anchoring or supporting surface construction on such soft soils. Soilcrete columns have been overlapped to form boundary walls, low to medium capacity soil-mixed caissons, and piles which act as a base for construction.

One application for boundary walls constructed of soilcrete columns which has been found to be particularly useful is as a pressure retaining wall, such as a wall which is subject to hydrostatic pressure. For example, walls constructed of soilcrete columns have been found to be particularly useful in underground construction work when ground water levels interfere with construction. Such structural boundary walls also find useful application as a retaining wall to provide lateral support for ground adjacent sites of excavation.

For example, the construction of large buildings in metropolitan areas often requires deep excavation immediately adjacent a street or plaza which would be in danger of crumbling unless some precaution were taken to provide lateral support to these areas. By first constructing a structural boundary wall, excavation may take place without the danger of injury to property adjacent the construction site.

Construction of subways, underground parking facilities, and sewage tunnels may also be facilitated by the use of soilcrete boundary walls to assist in controlling both the ground water problem and to provide lateral support to land adjacent the construction site. Indeed, boundary walls constructed from soilcrete columns have been found particularly useful in many applications where the wall is subject to hydrostatic pressure or pressure from other sources.

Although soilcrete columns do not typically contain cement, the strength characteristics of such columns are very similar to columns made of cement. Such columns tend to be very strong in compression but, because of their brittle nature, are relatively weak when subjected to forces which place any portion of the columns in tension.

When a wall constructed from soilcrete columns is used in a structural boundary wall application, it is subjected to lateral pressure on one side. The forces imparted on the wall place a bending moment on the columns, thereby subjecting one side of the columns to tensile stresses.

If the tensile stresses are of sufficient magnitude, brittle fractures will occur in the columns, thereby reducing the strength of the columns and possibly even causing the columns to fail. Such a result could have disastrous consequences particularly when the columns are used as a structural foundation for large buildings or other applications wherein human life could be placed in jeopardy by the failure of these columns.

One solution for strengthening soilcrete columns which has been proposed by the prior art is simply to build walls of columns having a greater diameter. Building walls comprised of larger diameter columns, however, requires larger, more expensive equipment and increased labor, resulting in a substantial (and a potentially prohibitive) increase in the costs of construction.

An even more fundamental problem with building larger diameter columns is that the morphology of the columns is not changed by increasing the diameter of the columns; the columns are still brittle and unable to withstand large tensile stresses. If subjected to a large enough tensile force, the same problems will occur. Building walls made up of larger diameter columns, therefore, has found to be an unacceptable solution to the problem.

An alternative solution which has been proposed by the prior art is to place a load bearing member, such as a steel I-beam, within the columns, thereby forming a composite column. This proposed solution is depicted in FIG. 1. When such a composite column is subjected to the bending moments described above, thereby placing certain portions of the column in tension, the reinforcing member, which is very strong in tension, bears those loads. A composite column of this nature thus retains the advantage of being strong in compression, thereby enabling it to be used in a foundation application, while also having increased tensile properties over non-composite soilcrete columns as is required if the columns are to be used to form a boundary wall.

A structural diaphragm wall constructed of composite soilcrete columns as described above, however, also has some disadvantages. It will be appreciated that the cost of placing an I-beam of similar structural member within each of the soilcrete columns can be extremely expensive. Construction of soilcrete columns requires large, expensive machinery. Additionally, the construction process is highly labor intensive. If a structural member is to be placed within each column which forms the diaphragm wall, the high costs of labor and materials can effectively outweigh the other advantages associated with in situ soilcrete column construction.

It has been found that the extra cost associated with placing a structural member in each column can be drastically decreased while maintaining the structural advantages of the composite columns described above by placing a reinforcing member only in alternating columns. Such a prior art configuration is illustrated in FIG. 2. This configuration reduces by one-half the number of reinforcing members needed to construct a wall. The approach of FIG. 2 results not only in a cost savings for materials, but also decreases significantly the amount of labor required to construct a reinforced structural diaphragm wall.

Although the strength and load-bearing capacity supplied by the structural members is reduced because of the elimination of some of the structural members, it has been found that the configuration of FIG. 2 has sufficient strength for some applications. FIGS. 3, 4, and 5 also illustrate various configurations employed by the prior art in an attempt to reduce labor, construction time, and material cost while maintaining a structural diaphragm wall with the strength characteristics necessary to withstand the pressures imposed on the wall.

It will be appreciated by those skilled in the art, nevertheless, that a soilcrete wall configured as illustrated in any of FIGS. 2 through 5 will not have nearly the same strength in tension as a wall configured as illustrated in FIG. 1.

Although walls constructed with alternating composite columns may be constructed at a lower cost than walls using all composite columns, such soilcrete walls may still be prohibitively expensive thereby rendering their use impractical for many applications. As a stronger wall is required, larger diameter auger equipment must be used to drill soilcrete columns having a larger diameter thereby enabling a larger structural member to be placed within the column to provide the additional required strength. Construction costs thus increase dramatically as the required strength of the wall increases.

From the foregoing, it will be appreciated that what is needed in the art are in situ reinforced structural diaphragm walls and methods of manufacturing such walls in which the structural advantages of walls comprised of soilcrete columns containing reinforcing members, such as steel I-beams, in alternating columns are utilized and which may be constructed such that both the capital and the operating costs associated with such construction are lower than those costs associated with the structural diaphragm walls of the prior art.

It would also be an advancement in the art if such walls could be provided which have load bearing capabilities equivalent or superior to those of prior art walls but which can be constructed according to a more efficient design whereby the load bearing capacity of the wall is enhanced and the time and the costs of construction are reduced.

Such walls and methods for construction are disclosed and claimed herein.

BRIEF SUMMARY AND OBJECTS OF THE INVENTION

The present invention is directed to structural diaphragm walls and methods for constructing such walls which are comprised of a series of soilcrete columns of differing diameters, which columns employ a structural member, such as a steel I-beam, in an alternating fashion such that every other column comprising the structural diaphragm wall includes a structural member.

In one of the presently preferred embodiments of the present invention, soilcrete columns of two diameters are employed in the structural diaphragm wall. The wall is configured such that large-diameter columns are alternated with small-diameter columns. A structural member, such as a steel I-beam, is placed within each of the small-diameter columns, thereby providing the structural diaphragm wall with the load bearing capacity to withstand lateral pressure, whether imposed by soil or water. As used herein, "lateral forces" refers to those components of the forces acting on the wall which are perpendicular to the wall.

It has been found that this particular embodiment of the present invention, with structural members employed within the small-diameter columns, has particular application for projects which require shallow excavation (less than approximately 50 feet) or when operating in silty soil or soft clay.

One advantage of the structural diaphragm wall described above is that lateral forces applied to the large-diameter soilcrete columns are channeled through the large-diameter columns to the small-diameter columns. Those small-diameter columns contain the structural members which support the load. This effect, sometimes referred to herein as an "arching" effect, allows the structural diaphragm wall to bear larger lateral forces than those configurations of the prior art wherein soilcrete columns of equal diameter are employed throughout the wall. The structural diaphragm wall of the present invention is configured to take maximum advantage of the efficient distribution of forces among the soilcrete columns, thereby eliminating excess column thickness where possible.

In a second preferred embodiment of the present invention, the same configuration of dual-diameter soilcrete columns is employed. Rather than placing a structural member within those columns having a small diameter, the structural member is placed within only those columns having a large diameter. Placing the structural member within the columns having a larger diameter enables a larger structural member to be employed, thereby providing the wall with increased strength.

This embodiment has been found to be particularly useful for applications requiring deep excavation (greater than approximately 50 feet) or when working in sandy soil conditions. A wall constructed according to this embodiment of the present invention is extremely strong, and has great load bearing capabilities for loads arising from lateral pressure imposed by soil and/or water.

As with the previously described embodiment, this configuration is more efficient than prior art walls because it employs a dual-diameter column configuration, thereby greatly reducing the costs of construction. This configuration may be used when a stronger wall is required.

Whereas prior art methods would dictate that a wall of single-diameter columns be constructed when a structural diaphragm wall is desired, the present invention employs a dual-diameter column configuration which allows the use of various sizes of structural members within the columns. This configuration is as structurally capable as its prior art counterparts, but may be constructed more quickly and economically.

In the construction of structural diaphragm walls according to the present invention, a three-shaft auger machine having a large-diameter center auger and two small-diameter outside augers may be used. Alternatively, a three-shaft auger machine with a small-diameter center auger and two large-diameter outside augers may also be employed. The auger machine may be used to penetrate downwardly through the ground and to mix a "cement milk" slurry with the soil.

The augers form a first outside soilcrete column, a center soilcrete column, and a second outside soilcrete column. The outside soilcrete columns have a different diameter than the inside soilcrete column.

After the augers are withdrawn from the soil, the auger machine is advanced horizontally such that the first outside auger is spaced a distance equal to the diameter of the inner auger from the recently formed second outside soilcrete column. Three additional soilcrete columns are formed as described above, and the augers are withdrawn from the soil.

The auger machine is then moved back such that the first outside auger is positioned over the previously formed second outside column, and the second outside auger is positioned over the recently formed first outside column. As the augers penetrate the ground, the soil is thoroughly blended with the chemical hardener and each of the previously formed columns is linked to form a continuous soilcrete wall.

According to this method of construction, the "outside" columns are each drilled twice with the auger machine. If an auger machine having a large-diameter center auger and small-diameter outside auger is employed, and if the configuration of the present invention to be employed is that of placing the structural member within the small-diameter columns, then the structural member may be placed within the column after the second and final drilling of the column.

If the structural member is to be placed within the large-diameter columns, the columns may be fit with the structural member immediately after the large-diameter column is formed because the large-diameter column is only drilled once. It may, however, be more convenient to wait until both adjacent small-diameter columns have been drilled twice before fitting the large-diameter column with the structural member, thereby eliminating the possibility that the structural member may interfere with the drilling of the adjacent column.

If an auger machine having a small-diameter center auger and large-diameter outside augers is used in constructing the structural diaphragm wall, then the large-diameter soilcrete columns will each be drilled twice before they may be fit with a structural member. If the structural member is to be placed within the small-diameter columns, this may be done immediately after the column is formed. However, as mentioned above, it may be preferred that the structural member not be placed within the column until drilling has been completed on both the adjacent large-diameter columns.

After the soilcrete column has been formed by the auger machine, the structural member may be placed within the column. The structural member must be placed within the column before the soilcrete mixture cures, i.e., while the soilcrete mixture within the column is still "wet."

The structural member is simply aligned above the column and then directed into the column through the wet soilcrete. Because of the weight of the structural members employed in this type of construction (typically in excess of 50 pounds per linear foot), the structural member will usually penetrate the soilcrete mixture solely under the force of gravity. If, however, the soilcrete mixture has begun to cure or if a lightweight structural member is employed, it may be necessary to apply some external forces to the structural member to assist it into the soilcrete column.

After the soilcrete columns have been fit within a structural member in an alternating fashion as described above, the soilcrete is allowed to dry and the structural member becomes rigidly bonded within the column. The resulting structural diaphragm wall is then capable of withstanding compression resulting from loads applied at the "ends" of the columns, such as in a foundation application, and tension resulting from the bending moments applied to the wall by lateral forces.

It is, therefore, an object of the present invention to provide a structural diaphragm wall and methods for constructing such a wall wherein the wall is comprised of soilcrete columns and capable of withstanding the lateral forces which may be imparted to the wall by soil or water and wherein the lateral forces imparted to the wall are channeled to load bearing columns constructed to withstand the loads applied to the wall by the lateral forces.

It is also an object of the present invention to provide a structural diaphragm wall comprised of soilcrete columns and capable of withstanding lateral forces which may employ large structural reinforcing members without increasing the diameter of all of the soilcrete columns which comprise the wall.

It is a further object of the present invention to provide such structural diaphragm walls and methods of construction which require less time for construction than prior art walls of similar strength and which may be constructed at a lower cost than such prior art walls, thereby reducing both the operating and capital costs during construction.

It is an additional object of the present invention to provide a structural diaphragm wall comprised of soilcrete columns which may be effectively used in silty soils or soft clay or in applications where only shallow excavation is necessary.

Yet another object of the present invention is to provide a structural diaphragm wall comprised of soilcrete columns which may be employed in soils which are sandy or in any application which requires deep excavation.

These and other objects and features of the present invention will become more fully apparent from the following description and appended claims, taken in conjunction with the accompanying drawings.

DETAILED DESCRIPTION OF THE PREFERRED EMBODIMENTS

Figure 1:
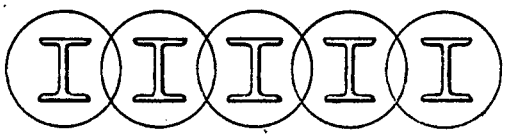
FIG. 1 (PRIOR ART)
FIG. 1 is a cross-sectional view of one of the prior art configurations of a reinforced soilcrete wall relating to the present invention wherein a structural member has been placed within each soilcrete column comprising the boundary wall.
Figure 2:
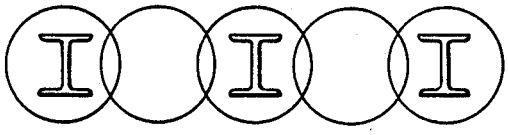
FIG. 2 (PRIOR ART)
FIG. 2 is a cross-sectional view of a second prior art configuration of a reinforced soilcrete wall relating to the present invention wherein a structural member has been placed within alternating soilcrete columns.
Figure 3:
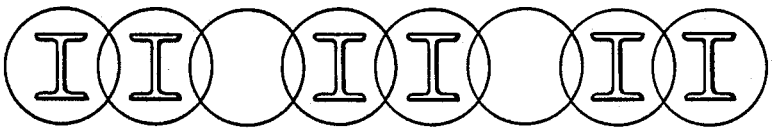
FIG. 3 (PRIOR ART)
FIGS. 3, 4, and 5 are cross-sectional views of prior art configurations of a reinforced soilcrete wall relating to the present invention showing alternative configurations for the placement of structural members within the soilcrete columns comprising the boundary wall.
Figure 4:
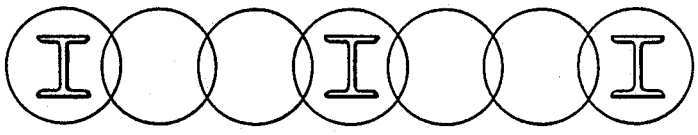
FIG. 4 (PRIOR ART)
Figure 5:
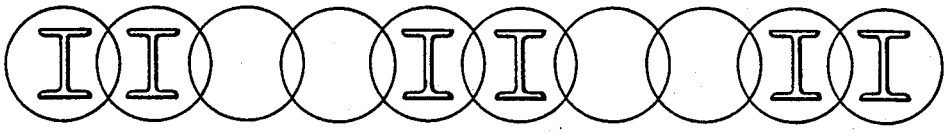
FIG. 5 (PRIOR ART)
Figure 6:
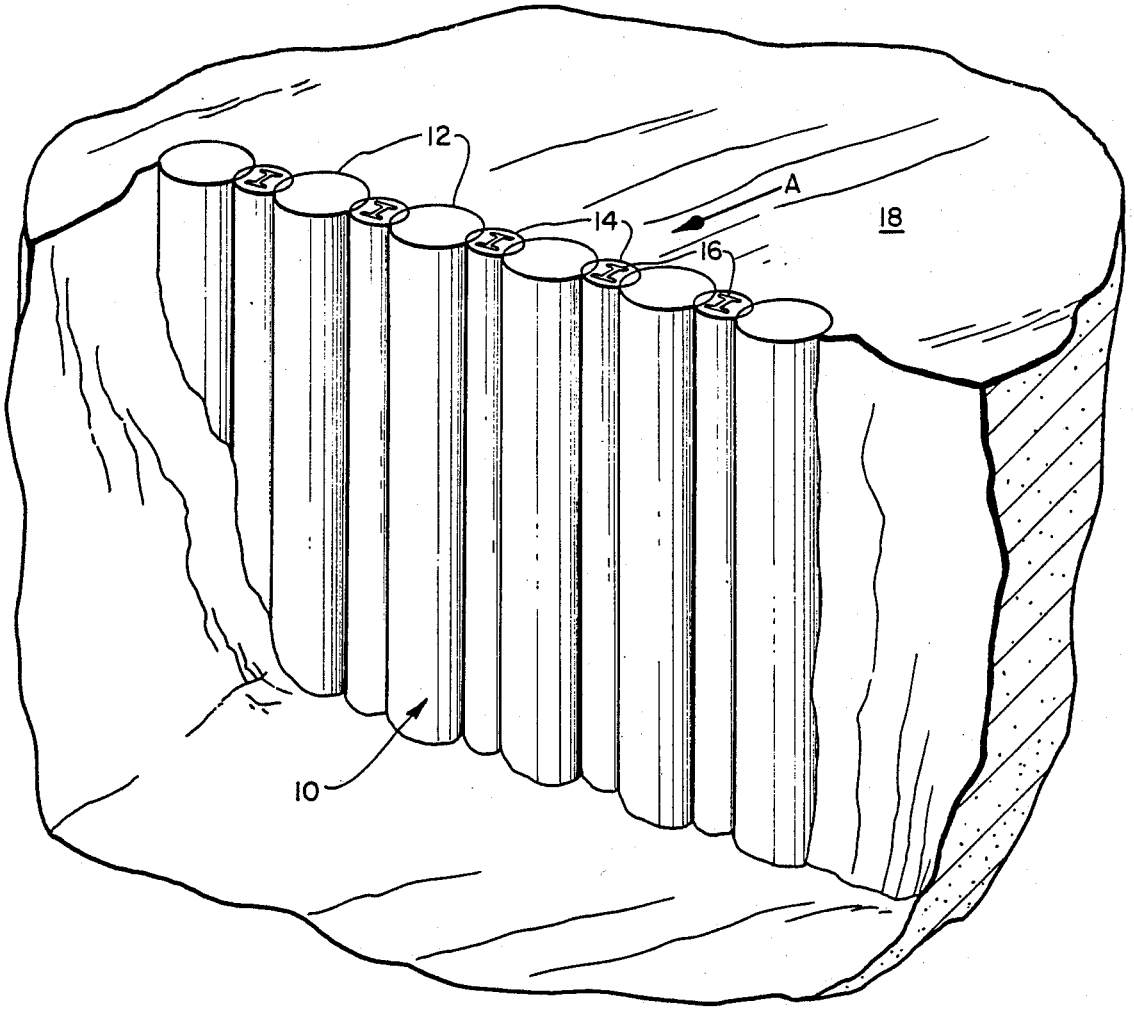
FIG. 6 is a perspective view of the structural diaphragm wall of the present invention as the present invention may be used as a boundary wall to prevent the lateral displacement of soil following excavation.

Reference is now made to the drawings wherein like parts are designated with like numerals throughout. Referring initially to FIG. 6, one presently preferred embodiment within the scope of the present invention is illustrated as the present invention may be employed to prevent the lateral displacement of soil during excavation of adjacent land.

In FIG. 6, the structural diaphragm wall, shown generically as 10, is shown as it may be used during construction of a highway, large building, or other structure to prevent soil adjacent the construction site from collapsing after excavation on the construction site has been commenced.

The structural diaphragm wall of the present invention also finds application for use in many underground applications such as in the construction of subways, underground parking facilities, and sewage tunnels. In these applications, the structural diaphragm wall is useful not only for providing lateral support to soil adjacent the construction, but also in controlling the ground-water problem which is often present in underground construction.

The structural diaphragm wall 10 is comprised of a series of soilcrete columns. The large-diameter columns 12 are spaced alternately with the small-diameter columns 14. In the embodiment of the present invention illustrated in FIG. 6, each small-diameter column 14 is fitted with a structural member 16, shown as an I-beam in FIG. 6. The soil 18 adjacent the wall applies a lateral force to the diaphragm wall 10 in the direction of arrow A.

Figure 7:
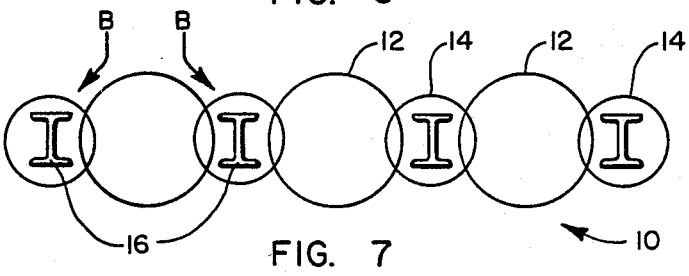
FIG. 7 is a cross-sectional view of the embodiment illustrated in FIG. 6.

FIG. 7 more particularly illustrates the configuration of the structural diaphragm wall of the present invention which was employed in combination with the construction site illustrated in FIG. 6. As can be seen by reference to FIG. 7, the structural diaphragm wall 10 is comprised of soilcrete columns having two different diameters. The wall is configured such that the large-diameter columns 12 are spaced alternately with the small-diameter columns 14. A structural member 16 has been placed within each of the small-diameter columns 14, thereby giving the diaphragm wall 10 the ability to withstand lateral forces.

As lateral forces are applied to the wall 10 at the large-diameter columns 12, the stresses induced by those forces are effectively transmitted through the large-diameter columns 12 to the small-diameter columns 14 which contain a structural member 16. This "arching" effect may be thought of as directing the lateral forces towards the small-diameter columns 14, as illustrated by the arrows B. Thus, the wall 10 is capable of supporting lateral forces by employing a structural member 16 in alternating columns having a smaller diameter than those columns which do not contain a structural member.

The embodiment of the present invention illustrated in FIG. 7 has particular application for shallow excavation (less than approximately 50 feet). This embodiment of the structural diaphragm wall is also particularly suited for use in soft clay or silty soil. It will be appreciated by one skilled in the art that soft clay and silty soil do not tend to collapse as easily as sandy soil following vertical excavation. When excavation is necessary in sandy soil, a structural wall according to the present invention having increased strength, as will be explained below, may be preferable.

The ability to use columns of different diameters, while maintaining the structural integrity of the wall, enables the total number of columns which may be drilled to be reduced. Whereas prior art technology directed to structural soilcrete walls and methods for constructing such walls would dictate that columns of uniform diameters be employed in constructing a structural diaphragm wall, the present invention employs large-diameter columns to distribute the hydrostatic forces to the small-diameter, load bearing columns.

It will be appreciated that the diaphragm wall configuration of the present invention wherein a structural member is contained within the small-diameter soilcrete columns 14 is easier to construct, and therefore less expensive, than a wall comprised of all large-diameter soilcrete columns.

The auger machines which dig the boreholes and produce the soilcrete columns of the present invention require a tremendous amount of power to drive the shaft. Individual shaft power requirements are proportional to the cross-sectional area of the column. Thus, as the column radius increases, the shaft's power requirements increase by an amount proportional to the square of the radius of the column. By eliminating the need to construct a wall of all large-diameter columns, construction is less costly.

Figure 8:
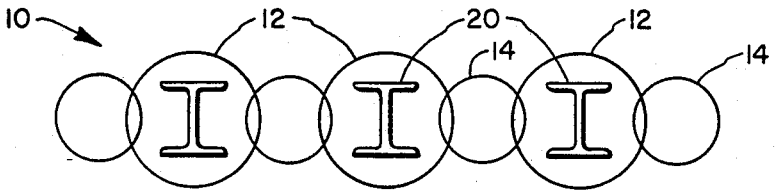
FIG. 8 is a cross-sectional view illustrating an alternative embodiment of the present invention.

An alternative embodiment of the present invention is illustrated in FIG. 8. In FIG. 8, the structural diaphragm wall 10 is again comprised of large-diameter soilcrete columns 12 in combination with small-diameter soilcrete columns 14 in an alternating fashion. However, in the embodiment of the present invention illustrated in FIG. 8, a structural member 20 is placed within the large-diameter columns 12.

Because the structural member 20 is placed within the large-diameter soilcrete columns 12 rather than within the small-diameter columns 14, a larger structural member 20 may be employed. Employing a larger structural member 20 in the diaphragm wall 10 causes the wall to be stronger by increasing its load bearing capabilities against lateral forces.

Thus, when construction parameters require a particularly strong diaphragm wall, the embodiment illustrated in FIG. 8 may be employed. Situations requiring a wall having extra strength may include conditions of deep excavation (greater than approximately 50 feet) or the necessity of working in sandy soil, wherein the lateral support supplied by the soil is minimal.

Although structural member 16 and structural member 20, as employed in the embodiments of the present invention illustrated in FIGS. 7 and 8, respectively, are illustrated as I-beams, it will be appreciated by one skilled in the art that various types of load-bearing members may be used including beams of numerous cross-sectional configurations. The light-weight, steel I-beam shown is merely illustrative of one type of load-bearing member which may be used.

For some applications, pipe, angle iron, or other cross-sectional configurations may be more structurally efficient than the I-beam illustrated in FIGS. 7 and 8. Although structural members are not limited to certain materials or cross-sectional configurations, they must be capable of withstanding the bending moments arising from the lateral forces applied to the boundary walls by the soil or water acting against the wall.

Figure 12:
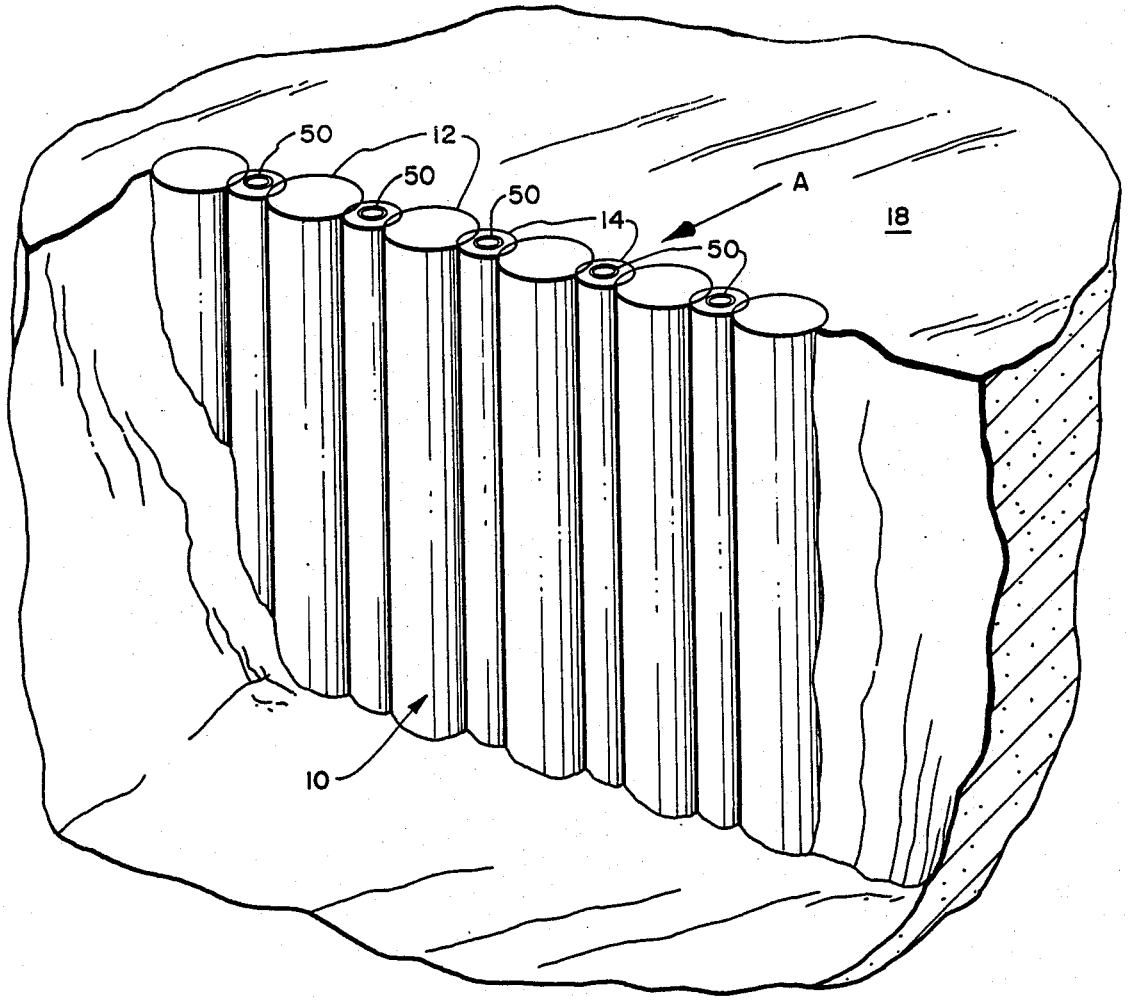
FIG. 12 is a perspective view of another structural diaphragm wall of the present invention which may be used as a boundary wall to prevent the lateral displacement of soil following excavation.
Figure 13:
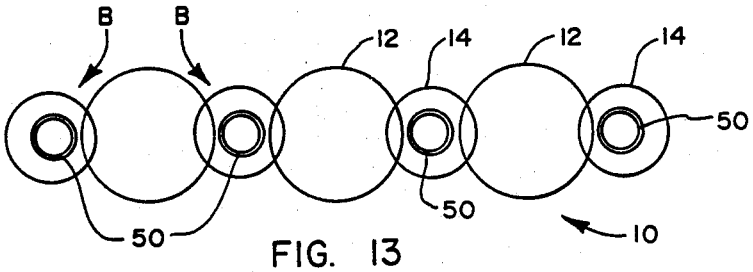
FIG. 13 is a cross-sectional view of the embodiment illustrated in FIG. 12.
Figure 14:
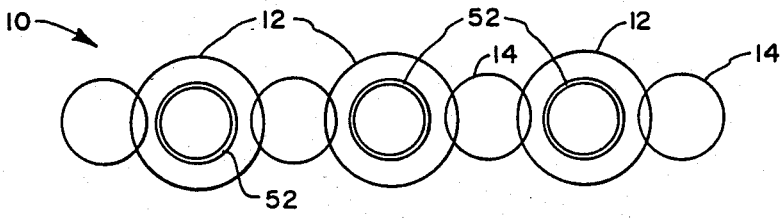
FIG. 14 is a cross-sectional view illustrating an alternative embodiment of the present invention.

FIGS. 12–14 illustrate structural diaphragm walls within the scope of the present invention similar to those illustrated in FIGS. 6–8, except that steel pipes 50 and 52 are used as load bearing members instead of I-beams 16 and 20.

Figure 9:
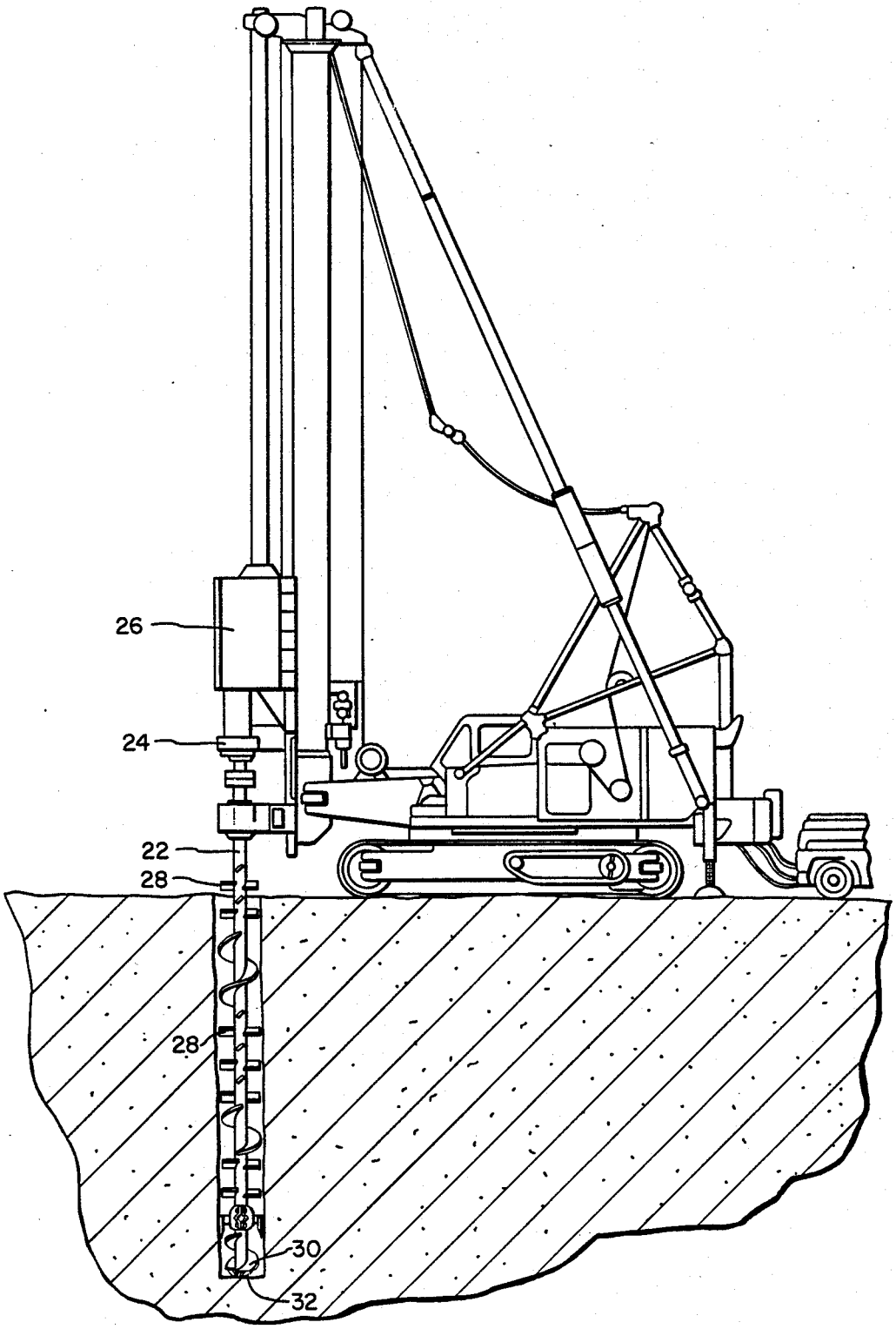
FIG. 9 is a plan view of an auger machine used in constructing the structural diaphragm wall of the present invention.

Construction of the structural diaphragm wall of the present invention may be explained by reference to FIG. 9. In FIG. 9, a multi-shaft auger machine is illustrated as the machine would appear in operation. Each shaft of the multi-shaft auger machine, shown generically as shaft 22, is attached to a gear box 24 at the upper end of the shaft. A motor 26 transfers power through the gear box 24 to the shafts 22.

Spaced throughout the length of each shaft 22 are intermittent soil mixing paddles 28 and auger blades 30 and 32. The intermittent auger blades 30 and 32 break up the soil and vertically mix the soil with a chemical hardener which is injected into the soil surrounding the shafts 22. The soil mixing paddles 28 further assist to break up the soil and horizontally mix the soil with the chemical hardener.

Figure 10:
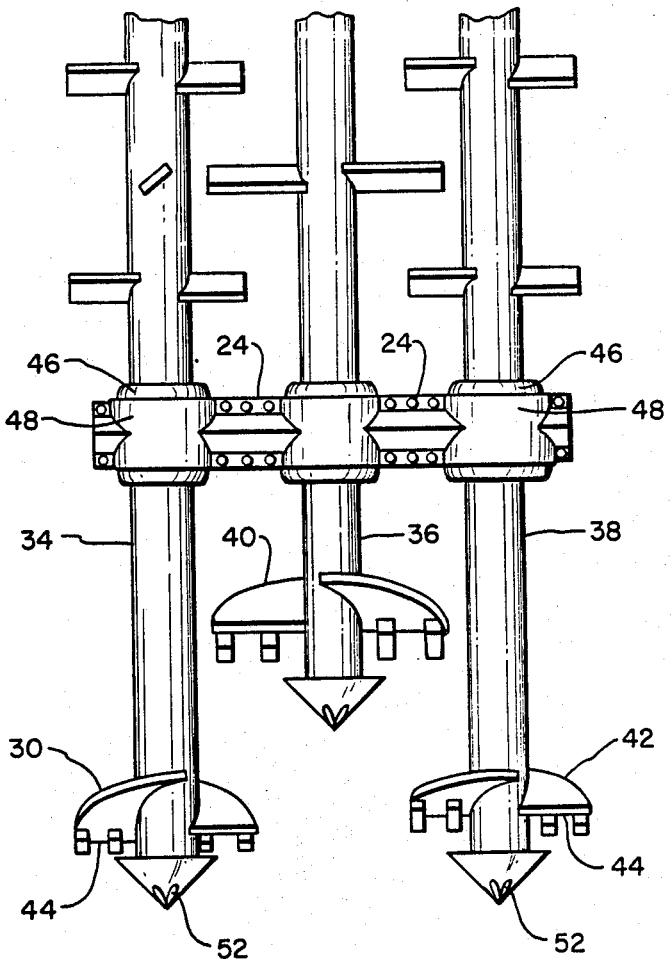
FIG. 10 is a plan view of a three-shaft auger used by an auger machine in constructing the structural diaphragm wall of the present invention.

FIG. 10 illustrates the details of a three-shaft auger machine used to construct the diaphragm wall of the present invention. The auger machine contains a first shaft 34, a second shaft 36, and a third shaft 38. Attached to the end of first shaft 34, second shaft 36, and third shaft 38 are first auger blade 30, second auger blade 40, and third auger blade 42, respectively. First auger blade 30 and third auger blade 42 are illustrated in FIG. 10 as having a small diameter while second auger blade 40 is illustrated as having a large diameter.

It will be appreciated that an auger machine configured such that first auger blade 30 and third auger blade 42 are of large diameter and second auger blade 40 is of a small diameter, may also be used in constructing the boundary walls of the present invention. Each auger blade possesses an auger cutting edge 44 which cuts into the soil at the bottom of each borehole. Auger teeth 32 are preferably secured to the cutting edge of the auger blades in order to assist in soil penetration in clay or rocky soils.

Each shaft of the auger machine is fit with a pair of cylindrical collars 46 spaced apart and formed around the periphery of each shaft. Collars 46 rotate with the shaft. Nonrotating bands 48 surround each shaft and are positioned between the cylindrical collars 46 on each shaft. The collars 46 prevent the nonrotating bands 48 from shifting vertically along the length of each shaft. Conventional bearing means (not shown) allows the shaft to rotate within the nonrotating bands.

Stabilizer bar 50 is securely attached to the nonrotating bands 48 to maintain proper shaft spacing and alignment. While nonrotating bands 48 and stabilizer bar 50 are illustrated as separate elements, it will be appreciated that they may be constructed of a single unitary piece. In addition, the bands and stabilizer bar may be constructed to be removable for easy assembly and disassembly of the shafts of the auger machine.

Still referring to FIG. 10, the bottom end of the first shaft 34, the second shaft 36, and the third shaft 38 contain discharge openings 52 from which a chemical hardener is discharged. This chemical hardener will typically include cement milk, bentonite, asphalt, and/or other hardeners or aggregates. It is from openings 52 that the chemical hardener (hereinafter sometimes referred to generically as "cement milk") is released into the soil to be mixed by the intermittent auger blades and soil mixing paddles along the length of the shafts in order to form a generally homogeneous mixture.

The resulting mixing of soil and chemical hardener is sometimes referred to as "soilcrete" because the hardener mixture often possesses physical properties similar to concrete. Nevertheless, use of the term "soilcrete" does not mean that soil is mixed with concrete or that the chemical hardener contains cement.

The inherent structure of a three-shaft auger machine provides for substantial column overlap. The substantial column overlap associated with the three-shaft auger machine exists because auger blades 30 and 42 attached to outer shafts 34 and 38, respectively, are vertically offset from auger blade 40 attached to inner shaft 36. Because the auger blades are offset, the shafts are positioned closer together thereby increasing the column overlap.

Generally, each shaft on a multi-shaft auger machine with three-shafts or more rotates in a direction opposite the rotation of adjacent shafts. As shown in FIG. 10, the auger blade attached to inner shaft 36 has a spiral configuration opposite the auger blades attached to outer shafts 34 and 38. Thus, inner shaft 36 rotates in a direction opposite outer shafts 34 and 38.

A three-shaft auger machine is ideally suited for constructing, in situ, the structural diaphragm walls of the present invention. While surface obstructions on the ground need to be removed prior to boring the columns (which form the continuous wall) with the multi-shaft auger machine, there is no need to excavate or remove substantial portions of the soil in order to form the wall.

Because the soil at the site of installation is used as an aggregate component material to be mixed with the cement milk in the construction of the walls, its quality has a direct bearing on the quality of the continuous wall formed according to the methods of the present invention. For this reason, rubble, abandon pipes, pieces of concrete, and other obstructions in the ground should be completely removed and replaced with good quality soil or aggregates. Suitable soil may consist of any ground composition capable of being mixed with a chemical hardener to create barrier walls. Sandy, clay, silty, or rocky compositions are examples of suitable soil compositions.

It will be appreciated that some excess soil is created during the construction process of the present invention. Hence, it is desirable to construct a small trench in which the excess soil can be placed. After the trench is excavated, a template is preferably used to mark each column's center on the edge of the trench, thereby making it possible to install the overlapped columns accurately.

A satisfactory template may consist of a concrete guide wall or simply a steel I-beam. The template assists in establishing the center of the continuous wall and the layout of the individual wall elements. The template further facilitates horizontal and vertical alignment of the wall's center.

After the machine alignment is checked, the auger machine starts to penetrate downwardly through the soil. The process of penetrating downwardly is often referred to as an augering stroke. As the auger blades move down to the predetermined depth, the injection of cement milk through the auger shaft is initiated. As the cement milk exits the auger shaft, it is mixed with the soil by the auger blades and mixing paddles along the length of each auger.

The resulting soil and cement milk mixture is referred to as a column or borehole. The use of the term "borehole" does not mean soil is removed to create a hole. Moreover, use of the term "column" may refer to a single in situ column formation or it may generically refer to wall formations or continuous large-area soil formations.

The mixing ratio of the cement milk to the soil is determined on the basis of the soil conditions which are determined and reported prior to boring the columns. The soil-cement mixing ratio is not decided solely on the basis of the strength conditions of the continuously wall, but such factors as the soil condition and the state of ground water are also taken into consideration in order to obtain a mixing ratio which will result in a substantially homogeneous wall which has the desired strength and integrity.

Cement milk continues to be pumped through the shaft and mixed with the soil as the augers are withdrawn from the boreholes. After sixty percent (60%) to eighty percent (80%) of the slurry is injected as the augers penetrate downward, and the remainder is injected as the augers are withdrawn so that the mixing process is repeated as the augers exit the borehole. Auger speed and slurry output quantities are set to meet the soil conditions of the site.

After the auger has been withdrawn from the borehole, a structural member such as a steel rod or a steel I-beam may be embedded into each columns. It has been found that if the linear weight density of the structural member is of sufficient magnitude, the structural member will penetrate the borehole through the soilcrete mixture under its own weight. It has been found that structural members having a linear weight density greater than approximately 50 pounds per foot are generally heavy enough to penetrate through wet soilcrete under their own weight. If the soilcrete has begun to harden or if the structural member does not have sufficient weight, it may be necessary to apply an external force to the structural member to aid in its penetration of the borehole.

Figure 11:
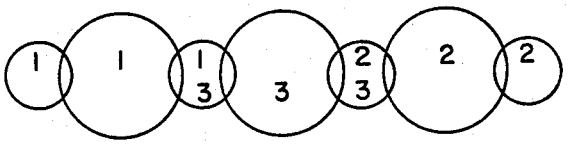
FIG. 11 is a view illustrating one augering stroke sequence which may be employed to construct the structural diaphragm wall of the present invention.

Continuous soilcrete diaphragm walls are constructed by linking sets of columns formed in a sequence of augering strokes. FIG. 11 illustrates an augering stroke sequence for constructing the structural diaphragm walls of the present invention. As shown in FIG. 11, after the first augering stroke, three soilcrete columns are formed, each numbered as column 1.

The multi-shaft auger machine is advanced horizontally such that the first shaft is positioned adjacent to the column previously formed by the third shaft a distance approximately equal to the diameter of the second shaft, allowing room for sufficient overlap of the columns. The second augering stroke forms three more soilcrete columns each numbered as column 2.

The multi-shaft auger machine is then moved to a position such that the first shaft is positioned over the third column formed during the first augering stroke and the third shaft is positioned over the first column formed during the second augering stroke. The third augering stroke joins the previously formed columns into a continuous wall formation. Columns formed during the third augering stroke are numbered as column 3. The process is repeated until the desired wall formation is complete.

The size of the structural member which may be used in the soilcrete column to form the composite column is solely a function of the diameter of the column. For example, it has been found that an 22 inch I-beam will conveniently fit within a soilcrete column having a diameter of 24 inches and a 20 inch I-beam will fit within a soilcrete column with a 34 inch diameter.

The diameter of the soilcrete columns used in connection with the structural boundary wall of the present invention may vary according to the personal preferences of the construction engineer or contractor. It has been found, however, that a three-shaft auger machine having two large-diameter auger blades of 34 inch diameters and one small-diameter auger blade of 22 inch diameter will function well in combination with a conventional motor. Also, it has been found that a conventional motor will work well with an auger machine having two small-diameter auger blades of 22 inch diameters and one large-diameter auger blades of 34 inch diameter. It will be appreciated that various combinations of columns having differing diameters may be used in constructing the wall of the present invention.

When the prior art would construct a wall consisting of columns each having a diameter of 22 inches, with a structural member placed within each column, a configuration of the present invention could be substituted to achieve lower capital costs and lower operating costs during construction than the prior art wall. For example, a structural diaphragm wall having a configuration as illustrated in FIG. 7, with large-diameter columns 12 having an approximate diameter of 34 inches and small-diameter columns 14 having an approximate diameter of 22 inches, would have approximately the same strength as the prior art wall described above. The structural wall of FIG. 7 would result in lower capital costs to construct because the amount of structural members employed in the wall is reduced by at least one-half.

As a wall of additional strength is required, prior art teachings would dictate that a wall consisting of columns each having a 34 inch diameter be constructed with a larger structural member within each column. Such a wall could be replaced with the configuration of the present invention illustrated in FIG. 8, with large-diameter columns 12 having an approximate diameter of 34 inches and small-diameter columns 14 having an approximate diameter of 22 inches.

Again, the wall of FIG. 8 would have strength roughly equivalent to the prior art wall but the wall of the present invention would result in lower operating costs during construction. Because every other column is of a smaller diameter than the columns used in the prior art wall, smaller equipment could be used to construct the wall of the present invention. Additionally, capital costs would also be reduced, as explained above, because of the cost savings associated with the reduction in the amount of structural members required.

These construction methods of the present invention eliminate several of the problems frequently encountered when conventional construction methods are employed. The stability of the soil is generally not endangered because the soil is not excavated or removed from the borehole. The soil mixes in situ with the cement milk in order to form the continuous wall.

The methods of the present invention also eliminate the need for many emergency provisions which are typically required at most excavational and construction sites because there is never an "open hole." Even if there is a major breakdown of the equipment or a power loss, the hole is never "open."

Safety is also enhanced by not having an open excavation. Only a small portion of the wall (one stroke) is being worked on at any one time, and this area is completely full of material. In addition, very little material is brought to the surface; any soil and mixture which is brought to the surface can be quickly and easily removed. There is no need for ponds, panels, or large quantities of fluid slurry present at any given time, so the risk of a significant slurry spill is eliminated.

The chemical hardener or cement milk composition varies depending upon the soil composition and the intended use of the soilcrete columns. In nearly all cases, the chemical hardener contains a cement or a cement substitute. Generically, chemical hardener or cement milk refers to anything mixed with soil to form a hardened column.

Quite often the cement milk often contains bentonite. Bentonite is added to make the wall impervious to water or to give a wall or column high strength. If a continuous wall is to be built along a riverside or some other body of water, then bentonite will preferably be a primary additive so that the resultant wall will permit only minimum water seepage through the wall. Bentonite may also be added to the cement milk when the soil is sandy or granular in order to provide an effective aggregate material with which to mix the slurry fluids.

If the column is to be constructed next to a preexisting wall, then fiber may be added to the cement milk composition. Fiber, in the form of cotton fibers or even lignin from sources such as soybeans, absorbs water and expands; thus, the new soilcrete wall will form a tight seal with the preexisting wall. Other additives, such as "CMS" paste or asphalt emulsions may be added to the cement milk to give the resulting wall additional watertight characteristics.

Typically the cement milk to be pumped into the borehole is made in a grout plant adjacent to the constructions site. The cement milk is pumped to the top of the auger shafts while the auger machine is in operation. It is particularly important to provide constant cement milk pressure and flow rate to each shaft of the multi-shaft auger machine in order to obtain a homogeneous mixture of the cement milk and the soil and to obtain a wall without weak sites. If one shaft receives more cement milk than the other shafts, nonhomogeneous columns will result.

From the foregoing, it will be appreciated that the present invention provides structural diaphragm walls and methods for constructing such walls which permit walls comprised of soilcrete columns to be constructed which have strength characteristics capable of withstanding lateral forces imposed by soil or water. The present invention permits efficient construction of continuous diaphragm walls which employ soilcrete columns of various diameters. By placing a structural member, such as a steel rod or I-beam, within alternating columns, the resulting structural diaphragm wall may be constructed more efficiently and at a lesser cost than those diaphragm walls taught in the prior art which use only single-diameter columns in their construction, thereby resulting in reduced capital costs and reduced operating costs in construction, as compared with wells of similar strength built according to the techniques of the prior art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for in situ formation of a reinforced structural wall in soil using a multi-shaft auger apparatus having at least one auger blade of a first diameter and at least one auger blade of a second diameter, the second diameter being different than the first diameter, the method comprising the steps of:

(a) augering downwardly into and through the soil with a three-shaft auger apparatus having two outside auger blades of the first diameter and a center auger blade of the second diameter such that the first plurality of boreholes of the first diameter are spaced alternatively with the second plurality of boreholes of the second diameter and such that the boreholes are adjacent, substantially parallel, vertical, and coplanar, and have a cross-sectional geometric configuration with overlap of the adjacent boreholes, the centers of the boreholes defining a geometric soil mixing plane;

(b) injecting a chemical hardener into the soil during the augering of the boreholes;

(c) blending the soil within the borehole with the chemical hardener;

(d) inserting a structural member within at least some of said boreholes; and (e) allowing the soil and chemical hardener blend to cure to form a hardened reinforced structural diaphragm wall.

2. A method for in situ formation of a reinforced structural wall in soil using a multi-shaft auger apparatus as defined in claim 1, wherein said insertion step comprises inserting a structural member within at least some of the first plurality of boreholes and not inserting any structural members within any of the second plurality of boreholes.

3. A method for in situ formation of a reinforced structural wall in soil using a multi-shaft auger apparatus as defined in claim 1, wherein said insertion step comprises inserting structural members within each of the first plurality of boreholes and not inserting any structural members within any of the second plurality of boreholes.

4. A method for in situ formation of a reinforced structural wall in soil using a multi-shaft auger apparatus as defined in claim 1, wherein said augering step comprises augering downwardly into and through the soil with a multi-shaft auger apparatus having the first diameter greater than the second diameter.

5. A method for in situ formation of a reinforced structural wall in soil using a multi-shaft auger apparatus as defined in claim 4, wherein said insertion step comprises inserting structural members within each of the first plurality of boreholes and not inserting any structural members within any of the second plurality of boreholes.

6. A method for in situ formation of a reinforced structural wall in soil using a multi-shaft auger apparatus as defined in claim 5, wherein said augering step comprises augering downwardly into and through the soil with a multi-shaft auger apparatus having a first diameter which measures between approximately 28 inches and approximately 34 inches and a second diameter which measures between approximately 20 inches and approximately 24 inches.

7. A method for in situ formation of a reinforced structural wall in soil using a multi-shaft auger apparatus as defined in claim 4, wherein said insertion step comprises inserting structural members within each of the second plurality of boreholes and not inserting any structural members within any of the first plurality of boreholes.

8. A method for in situ formation of a reinforced structural wall in soil using a multi-shaft auger apparatus as defined in claim 7, wherein said augering step comprises augering downwardly into and through the soil with a multi-shaft auger apparatus having a first diameter which measures between approximately 28 inches and approximately 34 inches and a second diameter which measure between approximately 20 inches and approximately 24 inches.

9. A method for in situ formation of a reinforced structural wall in soil using a multi-shaft auger apparatus as defined in claim 1, wherein said insertion step comprises inserting a structural member made of steel.

10. A method for in situ formation of a reinforced structural wall in soil using a multi-shaft auger apparatus as defined in claim 1, wherein said insertion step comprises inserting a structural member which is a steel I-beam.

11. A method for in situ formation of a reinforced structural wall in soil using a multi-shaft auger apparatus as defined in claim 1, wherein said insertion step comprises inserting a structural member which is a steel pipe.

12. A method for in situ formation of a reinforced structural wall in soil using a multi-shaft auger apparatus as defined in claim 1, wherein said injection step comprises injecting a chemical hardener into the soil which includes a cement product.

13. A method for in situ formation of a reinforced structural wall in soil using a multi-shaft auger apparatus as defined in claim 1, wherein said injection step comprises injecting a chemical hardener into the soil which includes bentonite.

14. A method for in situ construction of a reinforced structural wall in soil using a three-shaft auger apparatus with first and second outside auger blades of a first diameter and a center auger blade of a second diameter, the second diameter being different than the first diameter, the method comprising the steps of:

(a) augering a first borehole, a second borehole and a third borehole downwardly into and through the soil with the first outside auger blade, the center auger blade and the second outside auger blade, respectively, of the three-shaft auger apparatus such that the first, second and third boreholes are adjacent, the centers of the first, second and third boreholes defining a geometric soil mixing plane;

(b) injecting a chemical hardener into the soil during the augering of the first, second and third boreholes;

(c) blending the soil within the first, second and third boreholes with the chemical hardener to form a soil/hardener mixture;

(d) withdrawing the three-shaft auger apparatus from the first, second and third boreholes;

(e) moving the three-shaft auger apparatus such that the first outside auger blade is spaced from the third borehole a distance approximately equal to the diameter of the center auger blade;

(f) augering a fourth borehole, a fifth borehole and a sixth borehole downwardly into and through the soil with the first outside auger blade, the center auger blade and the second outside auger blade, respectively, of the three-shaft auger apparatus;

(g) injecting a chemical hardener into the soil during the augering of the fourth, fifth and sixth boreholes;

(h) blending the soil within the fourth, fifth and sixth boreholes with the chemical hardener to form a soil/hardener mixture;

(i) withdrawing the three-shaft auger apparatus from the fourth, fifth and sixth boreholes;

(j) moving the three-shaft auger apparatus such that the first outside auger blade is positioned over the third borehole and the second outside auger blade is positioned over the fourth borehole;

(k) reaugering the third borehole with the first outside auger blade, reaugering the fourth borehole with the second outside auger blade, and augering a seventh borehole with the center auger blade such that the seventh borehole is adjacent to the third borehole and the fourth borehole;

(l) injecting a chemical hardener into the soil of the seventh borehole during augering step (k);

(m) blending the soil within the seventh borehole with the chemical hardener to form a soil/hardener mixture;

(n) withdrawing the three-shaft auger apparatus from the third, fourth and seventh boreholes;

(o) inserting a structural member within at least some of the boreholes; and (p) allowing the soil/hardener mixture to cure to form a reinforced structural wall.

15. A method for in situ construction of a reinforced structural wall in soil using a three-shaft auger apparatus as defined in claim 14, further comprising the steps of sequentially repeating steps (e) through (n) in the soil adjacent the last augered boreholes such that the newly augered boreholes add to the existing wall of soil/hardener mixture.

16. A method for in situ construction of a reinforced structural wall in soil using a three-shaft auger apparatus as defined in claim 14, wherein step (o) comprises inserting a structural member within at least some of the boreholes augered with the outside auger blades, and not inserting any structural members within any of the boreholes augered with the center auger blade.

17. A method for in situ construction of a reinforced structural wall in soil using a three-shaft auger apparatus as defined in claim 14, wherein step (o) comprises inserting a structural member within each of the boreholes augered with the outside auger blades and not inserting any structural members within any of the boreholes augered with the center auger blade.

18. A method for in situ construction of a reinforced structural wall in soil using a three-shaft auger apparatus as defined in claim 14, wherein the first diameter is greater than the second diameter.

19. A method for in situ construction of a reinforced structural wall in soil using a three-shaft auger apparatus as defined in claim 18, wherein step (o) comprises inserting a structural member within each of the boreholes augered with the outside auger blades and not inserting any structural members within any of the boreholes augered with the center auger blade.

20. A method for in situ construction of a reinforced structural wall in soil using a three-shaft auger apparatus as defined in claim 19, wherein the first diameter measures between approximately 28 inches and approximately 34 inches and the second diameter measures between approximately 20 inches and approximately 24 inches.

21. A method for in situ construction of a reinforced structural wall in soil using a three-shaft auger apparatus as defined in claim 18, wherein step (o) comprises inserting a structural member within each of the boreholes augered with the center auger blade and not inserting any structural members within any of the boreholes augered with the outside auger blades.

22. A method for in situ construction of a reinforced structural wall in soil using a three-shaft auger apparatus as defined in claim 21, wherein the first diameter measures between approximately 28 inches and approximately 34 inches and the second diameter measures between approximately 20 inches and approximately 24 inches.

23. A method for in situ construction of a reinforced structural wall in soil using a three-shaft auger apparatus as defined in claim 14, wherein the structural member is made of steel.

24. A method for in situ construction of a reinforced structural wall in soil using a three-shaft auger apparatus as defined in claim 14, wherein step (o) comprises inserting a structural member which is a steel I-beam within at least some of the boreholes.

25. A method for in situ construction of a reinforced structural wall in soil using a three-shaft auger apparatus as defined in claim 14, wherein step (o) comprises inserting a structural member which is a steel pipe within at least some of the boreholes.

26. A method for in situ construction of a reinforced structural wall in soil using a three-shaft auger apparatus as defined in claim 14, wherein the chemical hardener injected into the soil includes a cement product.

27. A method for in situ construction of a reinforced structural wall in soil using a three-shaft auger apparatus as defined in claim 14, wherein the chemical hardener injected into the soil includes bentonite.

28. A reinforced structural wall which will withstand significant lateral forces, comprising:

a first plurality of substantially parallel, vertical, and coplanar soilcrete columns having a first diameter;

a second plurality of substantially parallel, vertical, and coplanar soilcrete columns having a second diameter substantially different from said first diameter, said second plurality of columns spaced alternately with said first plurality of columns and said second plurality of columns intersecting with said first plurality of columns to provide overlap of adjacent columns to form a wall; and a longitudinal structural member positioned within at least some of said columns, said structural member configured to bear the loads imposed by lateral forces acting upon the wall, thereby reinforcing the wall.

29. A reinforced structural wall which will withstand significant lateral forces as defined in claim 28, wherein said structural members are positioned within at least some of said first plurality of columns and not within any of said second plurality of columns.

30. A reinforced structural wall which will withstand significant lateral forces as defined in claim 28, wherein said structural members are positioned within each of said first plurality of columns and not within any of said second plurality of columns.

31. A reinforced structural wall which will withstand significant lateral forces as defined in claim 28, wherein said first diameter is greater than said second diameter, and wherein said structural members are positioned within each of said first plurality of columns and not within any of said second plurality of columns.

32. A reinforced structural wall which will withstand significant lateral forces as defined in claim 3, wherein said first diameter measures between approximately 28 inches and approximately 34 inches and said second diameter measures between approximately 20 inches and approximately 24 inches.

33. A reinforced structural wall which will withstand significant lateral forces as defined in claim 28, wherein said first diameter is greater than said second diameter, and wherein said structural members are positioned within each of said second plurality of columns and not within any of said first plurality of columns.

34. A reinforced structural wall which will withstand significant lateral forces as defined in claim 33, wherein said first diameter measures between approximately 28 inches and approximately 34 inches and said second diameter measures between approximately 20 inches and approximately 24 inches.

35. A reinforced structural wall which will withstand significant lateral forces as defined in claim 28, wherein said structural members are made of steel.

36. A reinforced structural wall which will withstand significant lateral forces as defined in claim 28, wherein said structural members are steel I-beams.

37. A reinforced structural wall which will withstand significant lateral forces as defined in claim 28, wherein said structural members are steel pipes.

* * * * *

UNITED STATES PATENT AND TRADEMARK OFFICE

CERTIFICATE OF CORRECTION

PATENT NO. : 4,909,675

DATED : March 20, 1990

INVENTOR(S) : Osamu Taki

It is certified that error appears in the above-identified patent and that said Letters Patent is hereby corrected as shown below:

The title page should be deleted to appear as per attached title page.

Column 2, line 57, "has found" should be --has been found--

Column 11, line 67, "each columns" should be --each column--

Column 18, line 43, "claim 3" should be --claim 31--

Signed and Sealed this

Twenty-ninth Day of September, 1992

*Attest:*

*Attesting Officer*

DOUGLAS B. COMER

*Acting Commissioner of Patents and Trademarks*

United States Patent [19]

Taki

[11] Patent Number: 4,909,675

[45] Date of Patent: Mar. 20, 1990

[54] IN SITU REINFORCED STRUCTURAL DIAPHRAGM WALLS AND METHODS OF MANUFACTURING

[76] Inventor: Osamu Taki, 2558 Somerset Dr., Belmont, Calif. 94002

[21] Appl. No.: 236,635

[22] Filed: Aug. 24, 1988

[51] Int. Cl.[4] ..... E02D 5/18

[52] U.S. Cl. ..... 405/267; 405/269; 405/241

[58] Field of Search ..... 405/267, 266, 258, 263, 405/269, 232, 240, 241

[56] References Cited

U.S. PATENT DOCUMENTS

| | | | |
|---|---|---|---|
| 3,823,562 | 7/1974 | Bacmanak | 405/267 |
| 3,969,902 | 7/1976 | Ichise et al. | 405/266 X |
| 4,043,909 | 8/1977 | Endo et al. | 210/49 |
| 4,063,424 | 12/1977 | Takagi et al. | 61/63 |
| 4,065,928 | 1/1978 | Takagi et al. | 61/36 |
| 4,065,933 | 1/1978 | Katayama | 61/50 |
| 4,069,678 | 1/1978 | Miura et al. | 61/63 |
| 4,084,383 | 4/1978 | Kukino et al. | 61/36 |
| 4,089,183 | 5/1978 | Endo et al. | 61/50 |
| 4,189,239 | 2/1980 | Miyaguchi et al. | 366/169 |
| 4,268,192 | 5/1981 | Colle | 405/267 X |
| 4,402,630 | 9/1983 | Miura et al. | 405/266 |
| 4,412,548 | 7/1980 | Miyaguchi et al. | 366/348 |
| 4,436,453 | 3/1984 | Miura et al. | 405/263 |
| 4,449,856 | 5/1984 | Tokoro et al. | 405/269 |
| 4,475,847 | 10/1984 | Cornely et al. | 405/264 |
| 4,537,536 | 8/1985 | Tsubonuma et al. | 405/267 |

FOREIGN PATENT DOCUMENTS

| | | | |
|---|---|---|---|
| 1072071 | 9/1954 | France | 405/267 |
| 51-71605 | 6/1976 | Japan . | |
| 52-78302 | 6/1977 | Japan . | |
| 52-152608 | 12/1977 | Japan . | |
| 55-44812 | 11/1980 | Japan . | |
| 0156317 | 12/1981 | Japan | 405/267 |
| 58-29374 | 6/1983 | Japan . | |
| 58-29375 | 6/1983 | Japan . | |
| 0189414 | 11/1983 | Japan | 405/267 |
| 0270414 | 11/1986 | Japan | 405/267 |

OTHER PUBLICATIONS

"S.M.W. Machine", Product Brochure of S.M.W. Seiko, Inc., San Francisco, Calif.

"Teno Column Method", Product Brochure of the Tenox Corporation, Toyko, Japan.

"Just One of Our Fleet", Product Advertisement, Casagrande S.p.A., Italy.

"The Soil Mixing Wall (SMW Technique)–Guidelines for Its Design and Implementation," Japanese Materials Institute.

"In Situ Soil Improvement Techniques, Lime Columns," Clough, Harbour & Assoc., New York.

Jasperse and Ryan, "Geotech Import: Deep Soil Mixing", Civil Engineering, pp. 66–68 (Dec. 1987).

*Primary Examiner*—Dennis L. Taylor

*Attorney, Agent, or Firm*—Workman, Nydegger & Jensen

[57] ABSTRACT

The present invention is directed to in situ structural diaphragm walls and methods for constructing such walls. The structural diaphragm walls of the present invention are comprised of a series of small and large-diameter soilcrete columns configured such that the small-diameter columns alternate with the large-diameter columns. A structural member, such as a steel I-beam, is placed within each of the small-diameter columns or within each of the large diameter columns, depending on the structural requirements of the resulting diaphragm wall.

The structural diaphragm wall is capable of withstanding the lateral forces which may be imposed by soil or water. Thus, the wall is ideally suited for construction applications when ground water must be restrained or when soil adjacent an excavation site is in danger of crumbling because of the loss of the lateral support which existed prior to excavation.

The method of constructing the structural diaphragm wall involves employing a three-shaft auger machine to construct a series of soilcrete columns. Before the soilcrete mixture cures, the structural diaphragm wall may be aligned with the column and directed into the column, usually under its own weight. The soilcrete mixture is then allowed to cure, resulting in the reinforced structural diaphragm wall of the present invention.

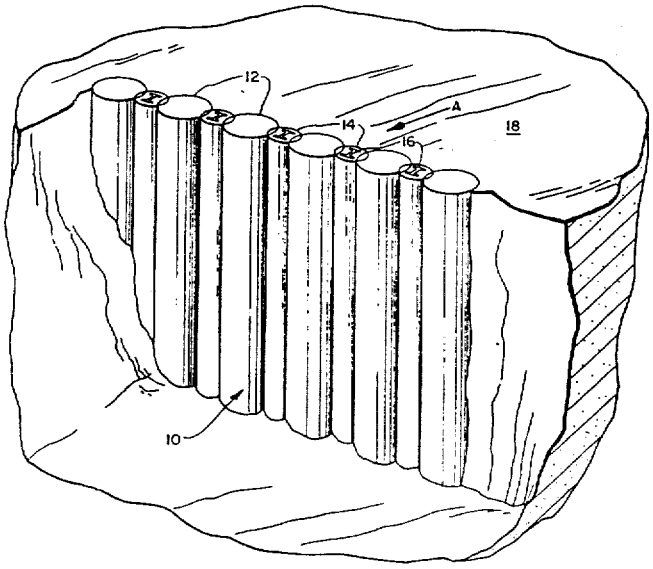

37 Claims, 5 Drawing Sheets